US005711360A

United States Patent [19]

Viotte

[11] Patent Number: 5,711,360

[45] Date of Patent: Jan. 27, 1998

[54] OPERATING DEVICE FOR ROLLING SHUTTER ASSEMBLIES

[75] Inventor: Christophe Viotte, Arc-Les-Gray, France

[73] Assignee: SIMU, Arc-les-Gray, France

[21] Appl. No.: 798,762

[22] Filed: Feb. 11, 1997

[30] Foreign Application Priority Data

Feb. 14, 1996 [FR] France ..... 96 02085

[51] Int. Cl.[6] ..... E06B 9/56

[52] U.S. Cl. ..... 160/310; 160/133

[58] Field of Search ..... 160/310, 133, 160/9, 8, 315, 188, 189, 191, 192; 74/625

[56] References Cited

U.S. PATENT DOCUMENTS

| | | | |
|---|---|---|---|
| 1,842,123 | 1/1932 | Rush | 160/8 |
| 2,019,085 | 10/1935 | Miller | 160/8 |
| 3,522,834 | 8/1970 | Corcoran | 160/133 X |
| 4,342,354 | 8/1982 | Leivenzon et al. | 160/133 |
| 4,422,493 | 12/1983 | Forquer | 160/133 |
| 4,503,899 | 3/1985 | Forquer | 160/133 |
| 4,515,024 | 5/1985 | Kataoka et al. . | |
| 5,083,600 | 1/1992 | Weishar et al. . | |

FOREIGN PATENT DOCUMENTS

| | | |
|---|---|---|
| 1270577 | 7/1960 | France . |
| 1391576 | 4/1964 | France . |
| 2411295 | 11/1978 | France . |
| 8803606 | 8/1988 | Germany . |

*Primary Examiner*—David M. Purol
*Attorney, Agent, or Firm*—Dowell & Dowell

[57] ABSTRACT

An operating device for a rolling shutter assembly comprising a reeling shaft for a shutter wherein the shaft is rotated by a motor connected to a flange. The flange is fixed to a toothed wheel that can mesh with a thread of a screw so as to immobilize the rotation of the flange. The thread of the screw is provided with at least one flat, so that the mechanical connection between the toothed wheel and the screw can be disengaged when a flat is positioned adjacent the toothed wheel. Disconnection of the screw from the wheel allows a rapid operation of the shutter for reasons of security or maintenance.

11 Claims, 6 Drawing Sheets

OPERATING DEVICE FOR ROLLING SHUTTER ASSEMBLIES

BACKGROUND OF THE INVENTION

1. Field of the Invention

The present invention relates to an operating device for rolling shutters.

2. History of the Related Art

Generally, a rolling shutter assembly comprises a shaft around which a shutter can be more or less rolled up according to the rotation of the shaft around its elongated axis. Driving systems for rotating the shaft are of diversified types. They may consist of an electric motor or of a mechanical winch. It is also possible that a user would operate the rolling shutter by direct action, for which is provided an equalizing mechanism capable of holding the shutter in a position in which it is left by the user.

In any case, sometimes it is necessary to disengage the rolling shutter's driving mechanism because of security reasons or to service the mechanism. In the previously known devices it was necessary to provide a specific disengaging system, which system had to be the subject of an elaborate study of the resistance of the materials and required the manufacture of specific parts.

SUMMARY OF THE INVENTION

The present invention is designed to provide an operating device for rolling shutters that allows an effective disengagement of the driving mechanism, which is low in cost, reliable to operate and easy to install.

With this in mind, the present invention relates to an operating device for rolling shutters comprising a reeling shaft for a shutter rotated by a motor held by a collar, characterized by the fact that the collar is attached to a toothed wheel that can engage with a screw so as to immobilize the rotating collar. The threads of the screw is provided with at least one flat, so that the mechanical connection between the toothed wheel and the screw can be engaged and disengaged.

According to the present invention, it is particularly easy to disengage the operating device because it suffices to turn the screw until one of its flats faces the toothed wheel; the play between the screw and the toothed wheel is then sufficient to allow a movement of one with respect to the other.

The invention is particularly attractive from a cost-effective point of view because it is based on the use of a toothed wheel and a screw that are widely used in mechanical winch drives of reeling shafts for rolling shutters. This use of elements, already widely known, avoids a thorough study of the resistance of the materials. In its customary application, the winch functions to block rotation as well as acts as a connection between several mechanical components. Thus, such a winch is already designed for use with this new application because essentially it carries out the same functions.

This use of already widely utilized components also avoids the duplication of components being machined because it is unnecessary to machine new parts. The thus obtained mass produced parts allows for a reduction in the unit price of components already in use.

From a mechanical point of view, the endless screw and the toothed wheel comprising the winch provide a reliable immobilization of rotation because the holding effect is obtained by a gear that is particularly suited for transmission action, and thus for the blocking or inhibiting of rotation.

These components provide an easily disengaged device because the angle of the gear is designed with respect to the rotation of the screw, even under stress; thus, it is easy to disengage the device. Moreover, the use of a system comprising a screw and a toothed wheel presupposes the assurance that, due to the multiple teeth disposed along the periphery of the wheel and to the continuity of the screw's thread, a re-engaging position can be easily and rapidly found.

According to an advantageous variation of the present invention, the screw is provided with two flats that are symmetrically arranged opposite to its elongated axis. Furthermore, the device can be provided with means for an elastic positioning of the screw.

Lastly, the present invention can be used with a device that comprises an equalizer spring suitable to cause the rotation of the shaft in such a manner as to roll-up the shutter when the connection between the wheel and the screw is disengaged. The present invention can also be used with a device that comprises a speed reduction unit for lowering the shutter when the connection between the toothed wheel and the screw is disengaged. In all cases, the screw can be formed by a simple tooling of a screw used in a standard operating device for rolling shutters provided with a mechanical winch.

BRIEF DESCRIPTION OF THE DRAWINGS

The present invention will be better understood and its other advantages will be more clearly elucidated in light of the below description of four embodiments of an operating device for rolling shutters in accordance with its principle, given solely by way of example and referenced in the hereto attached drawings wherein.

DESCRIPTION OF THE PREFERRED EMBODIMENT

Figure 1:
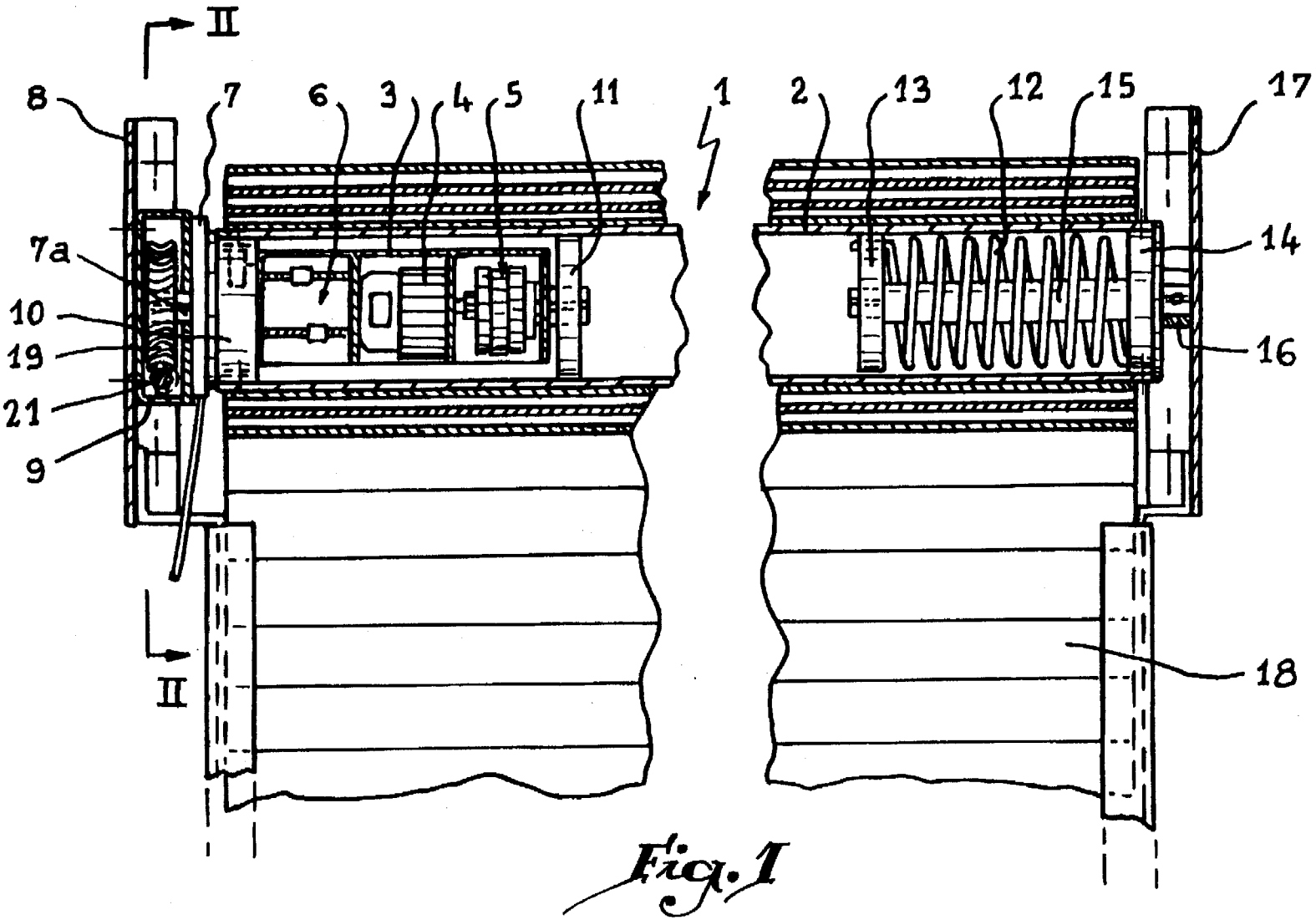
FIG. 1 shows a front cross-sectional view having portions broken away of a rolling shutter incorporating a first embodiment of the present invention.

The device 1 to operate rolling shutters shown in FIG. 1 is essentially constituted by a reeling shaft 2 on which is housed a tubular motor comprising a stationary housing 3 containing an electric motor 4, a reduction unit 5 and a limit switch 6. A flange 7 upon which rests the housing 3, is firmly attached to a stationary bracket 8 by means of a shaft 7*a* that extends into a housing 9 of which the sheathing is firmly attached to the bracket 8. A collar 10, affixed to the shaft 2, is provided with inside teeth that interact with a pinion, not shown herein, that conveys to the limit switch the movement of the shaft 2. The output shaft of the reduction unit 5 is provided with a disk 11 that is engaged with the shaft 2 and is suitable to impart a rotating movement from the motor to the reeling shaft.

An equalizer spring 12 is housed inside of the shaft 2 in the proximity of its other end. One end of the spring 12 is attached to a stationary disk 13 inside the shaft 2 while its other end is attached to a movable second disk 14 that rotates together with the shaft 2. A spindle 15 holds the disk 13 and it is attached by means of a bolt or strap 16 to a supporting bracket 17.

The mechanism operates as follows. When the shutter 18 of the rolling shutter assembly is completely wound up around the shaft 2, the equalizer spring 12 is not stretched. Should it be necessary to close the rolling shutter, the electric motor 4 is activated in such a manner that, through the reduction unit 5 and the driving disk 11, it imparts a torque on the shaft 2, which gradually unrolls the shutter 18. The rotating movement of the shaft 2 gradually stretches the spring 12 so that it stores energy. The movement of the shutter 18 may be stopped at any time by means of a brake, not shown herein, that is coupled to the motor 4. When it becomes necessary to roll-up the shutter 18 of the rolling shutter assembly, the motor is activated in a reverse direction in order to impart upon the shaft 2 a rotating movement in a reverse direction. The equalizer spring 12 then tends to cause the shaft 2 to rotate in the same direction as the motor 4 by releasing the energy it had stored at the time of the lowering of the shutter.

Figure 2:
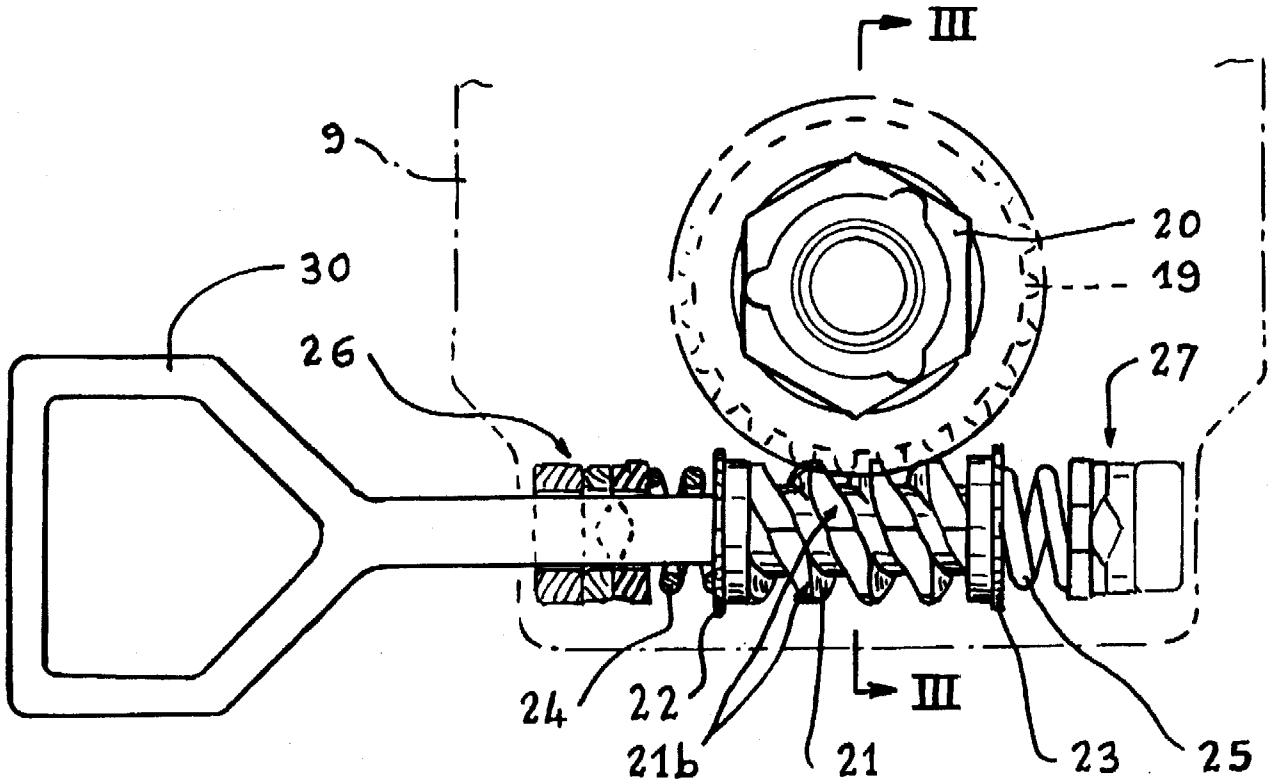
FIG. 2 is an enlarged cross-sectional view along the line II—II of FIG. 1, showing the device in an engaged position.

The equalizer spring 12 is dimensioned in such a manner that, in the absence of the motor 4 and the brake associated therewith, it causes the rewinding of the shutter. From FIG. 2 it can be clearly seen that the housing 9 includes a toothed wheel 19 that rotates together with the shaft 7*a*. The wheel is fixed to this shaft, by way of example, by a nut 20.

Figure 3:
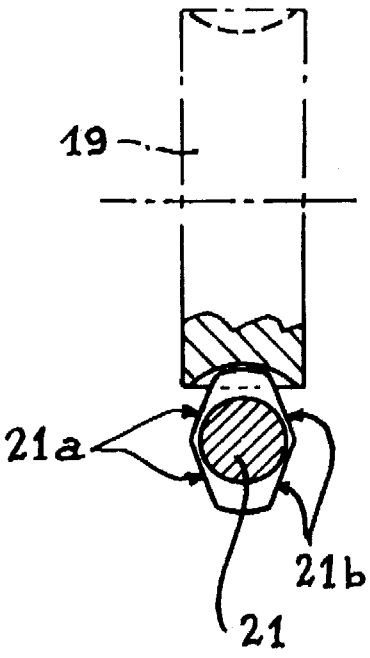
FIG. 3 is an enlarged cross-sectional view along the line III—III of FIG. 2.

In accordance with the present invention, an endless screw 21 is provided in the proximity of the toothed wheel 19, so that, as shown in FIG. 3, the teeth of the toothed wheel mesh with the thread of the screw 21. The screw 21 is a screw of the type used in an operating device for rolling shutters provided with a mechanical winch. Thus, the screw is a component that is already mass produced at a relatively low cost. This screw is held between two plates 22 and 23 and supported by the ends of two springs 24 and 25 resting against thrust bearings or nuts 26 and 27 of the housing 9. Thus, the springs 24 and 25 constitute a means for a resilient or elastic positioning of the screw 21 opposite or perpendicular to the axis of the shaft 2. A handle 30 is connected to the plate 22 through the bearing 26 and the spring 24. This handle enables the screw 21 to be rotated about its axis.

Figure 5:
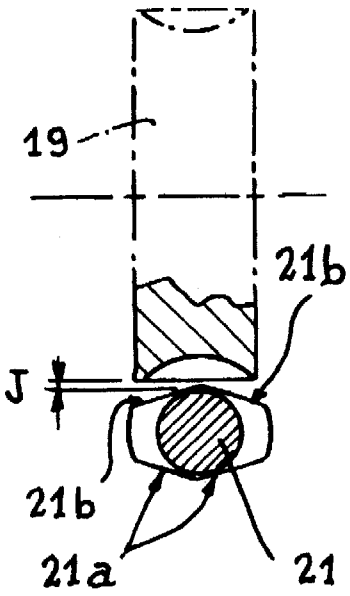
FIG. 5 is a sectional view similar to that of FIG. 3 showing the device disengaged.
Figure 4:
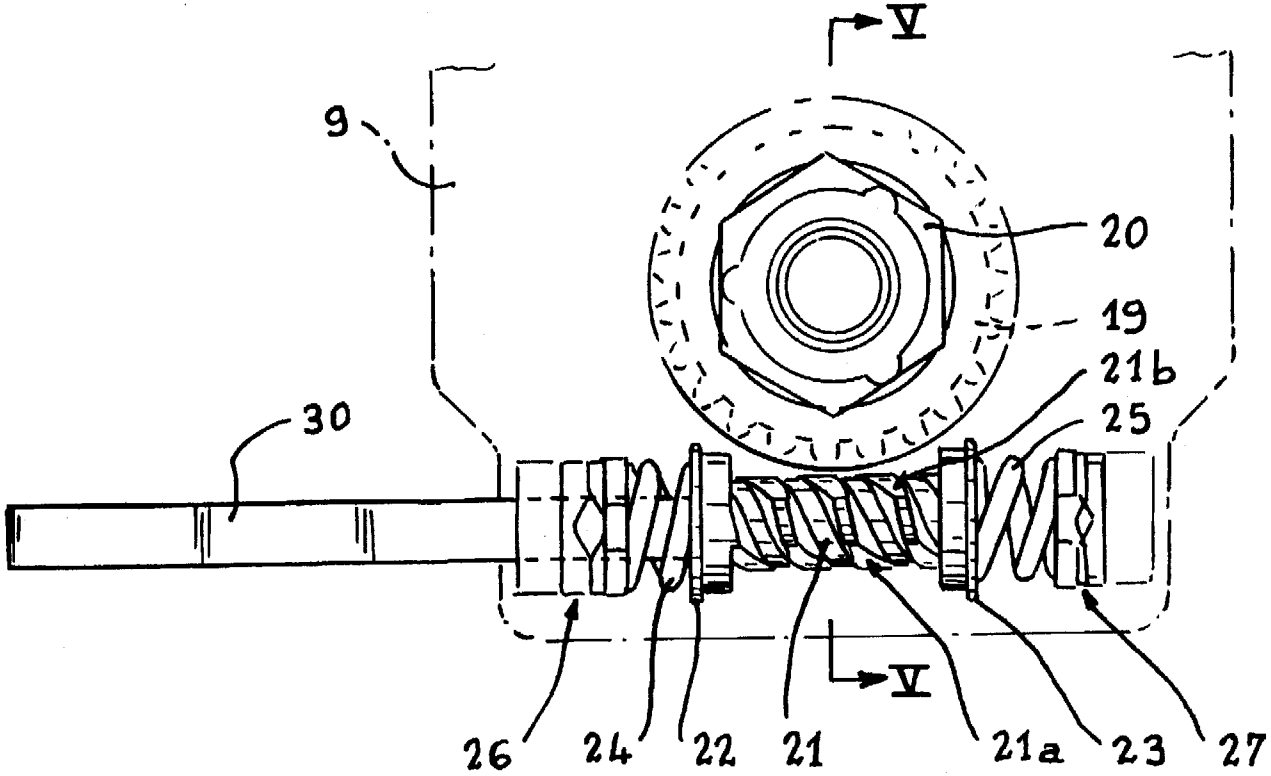
FIG. 4 is a view similar to that of FIG. 2, showing the device disengaged.

In accordance with the present invention, and more clearly shown in FIGS. 4 and 5, the screw threads are provided with pairs of two oppositely oriented flats 21*a* and 21*b*. These flats allow a space or play "J" to be created between the outside edges of the thread of the screw 21 and the outside edges of the teeth of the toothed wheel 19, so that the mechanical connection between the toothed wheel and the screw is disengaged when the screw is in the position shown in FIG. 5. Preferably, the play "J" should be of less than 10 mm and of the order of a few millimeters.

The embodiments of FIGS. 1 to 5 show the use of the present invention on a security shutter or door. In fact, when it becomes necessary to rapidly open the shutter by means of this embodiment, it suffices to turn the handle 30 one quarter of a turn in order to disengage the device and allow the rotation of the flange 7 and of the motor 4 so that, under the effect of the equalizer spring 12, and eventually by a vertical upward thrust, the shutter is rolled-up around the shaft 2.

When it becomes necessary to operate the device by means of the electric motor 4, it suffices to turn the handle 30 one quarter of a turn in the same or in the opposite direction in order to reestablish the mechanical connection between the toothed wheel 19 and the screw 21, as shown in FIG. 3. It can be noted that because of the design of the device with a toothed wheel and a screw, it is possible to easily and rapidly obtain the re-engagement because of the multiple teeth of the wheel 19 and of the threads of the screw 21 having the flats 21*a* and 21*b*.

Moreover, it is particularly easy to disengage the device. A turn of the handle 30 about the axis of the screw in a first direction or in the reverse trigonometric direction causes the device to disengage, which is of special importance when this device must be operated by an individual not familiarized with the device or acting in a state of panic.

It must be noted that due to the utilization of components used in large quantities by mechanical winches, the cost of these components is low and therefore the cost of the thus obtained release mechanism is also low.

Figure 6:
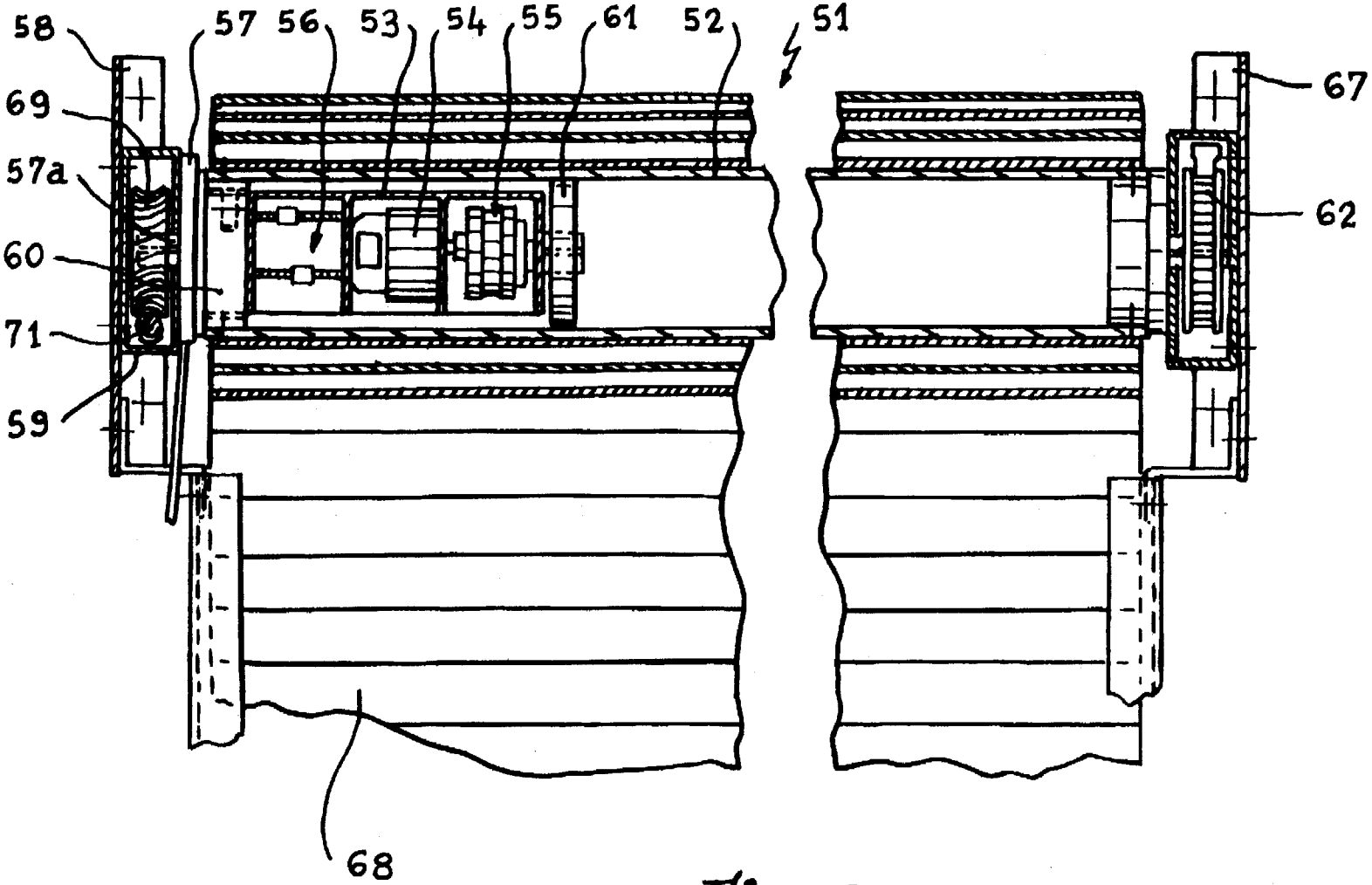
FIG. 6 is a view similar to that of FIG. 1, showing a second embodiment of an operating device for rolling shutters.

FIG. 6 shows an application of the invention on a fireproof door. The reference numbers of the parts or components similar or identical to those of FIG. 1 are increased by 50.

The essential difference between this device 51 and the embodiment of FIGS. 1 to 5 is that it does not have an equalizer spring and that a vibratory release unit 62 acts as a speed-reducer for the movement of the shaft 52. By using the invention, it is possible to disengage the mechanical connection between a toothed wheel 69 attached to the shaft 57*a* and a screw 71 mounted in a housing 59 secured to a bracket 58. When the mechanical connection between the toothed wheel 69 and the screw 71 is disengaged, the shutter 68 is driven by gravity and it is unwound from the shaft 52, while being slowed or restrained by the release unit 62.

This device is particularly advantageous for use with fireproof doors. In fact, as before, it is easy to manipulate the screw 71 to disengage the mechanical connection with the toothed wheel 69, thus releasing the shutter 68 in the case of fire. As in the previous embodiment, it suffices to turn the screw 71 one quarter turn in the reverse direction, or in the same direction, to re-engage the device to enable the movement of the shutter 68 to be actuated by means of the electric motor 54.

Figure 7:
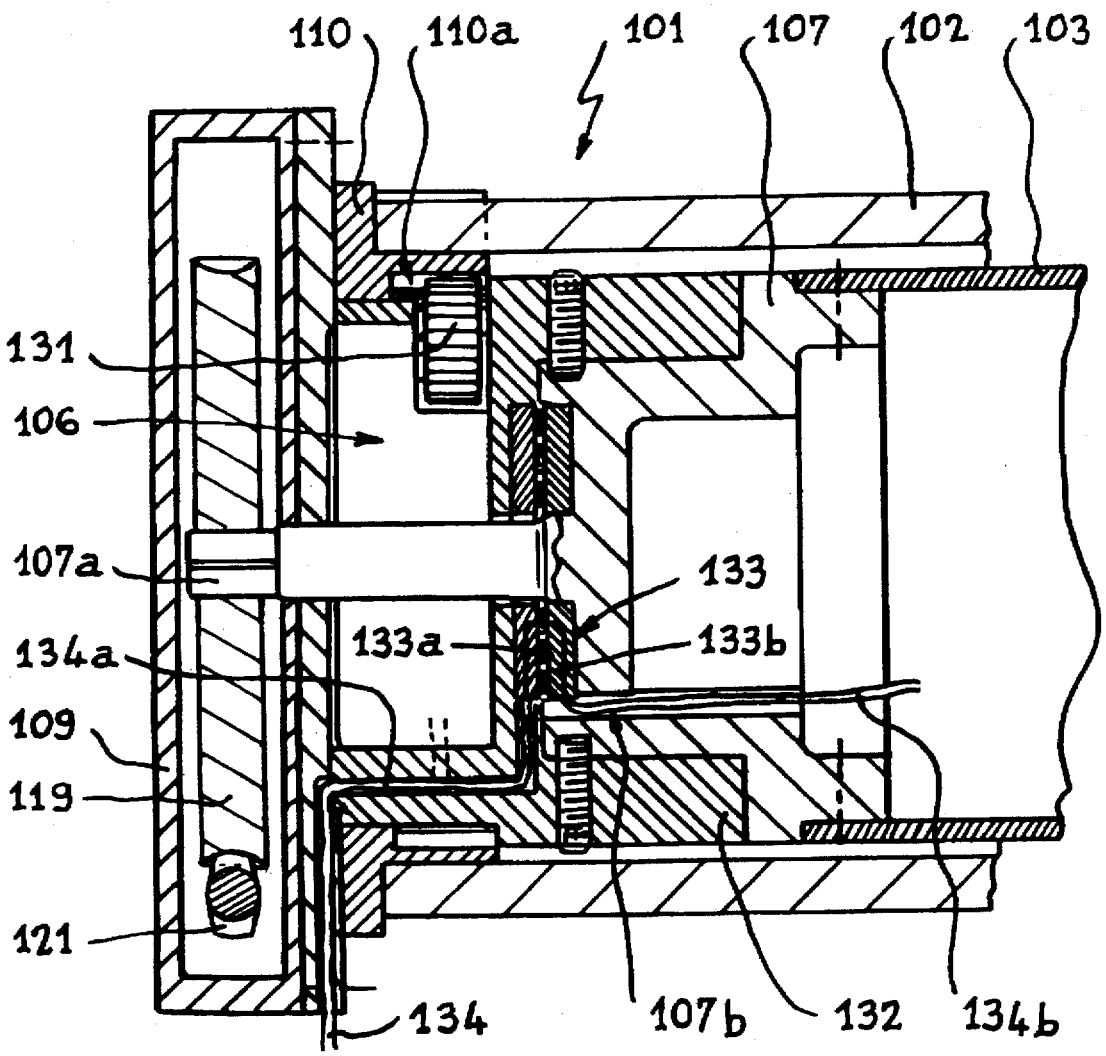
FIG. 7 is a detailed cross-sectional view of a portion of an operating device for rolling shutters in accordance with a third embodiment of the present invention.

FIG. 7 is a detailed view of a portion of an operating device for rolling shutters in accordance with a third embodiment of the present invention in which the reference numbers of the parts similar to those of FIG. 1 to FIG. 5 are increased by 100.

This device 101 comprises a reeling shaft 102 in which is set a housing 103 comprising an electric motor, not shown herein. A limit switch 106 is connected to a collar 110 that is fixed to the reeling shaft 102 by a driving pinion 131 which, because of the inside teeth 110*a* of the collar 110, imparts upon the device 106 the movements of the shaft 102. A flange 107 is fixed to the housing 103. A shaft 107*a* extends from the flange into a housing 109 that, in accordance with the present invention and similar to the first embodiment, includes a toothed wheel 119 and an endless screw 121. Moreover, this device includes a stationary part 132 housed in the shaft 102 and supporting the limit switch 106 and the flange 107. The part 132 carries one half 133*a* of a rotating connector 133, of which the other half 133*b* rests on the flange 107. The rotating connector can be of any known type and, by way of example, with contact brushes sliding on a contact surface. Through this connector, electric current is fed to the motor by means of a cable 134, of which one part is attached to the housing 109 and to part 132 while another part **134*b* enters into an aperture 107*b* in the flange 107**.

When the device of the present invention is disengaged, that is to say, when the endless screw is in its position in which a thread is spaced from the toothed wheel 119, the toothed wheel is being driven, by example, by an equalizer spring of the type shown in FIG. 1, and the flange 107 rotates in relation to the stationary part 132 so that an electric cable can be simply attached to these two components. The reason being, that the rotating connector 133 is provided between them so that the cable 134 will not be damaged by movement after the device is disengaged.

Figure 8:
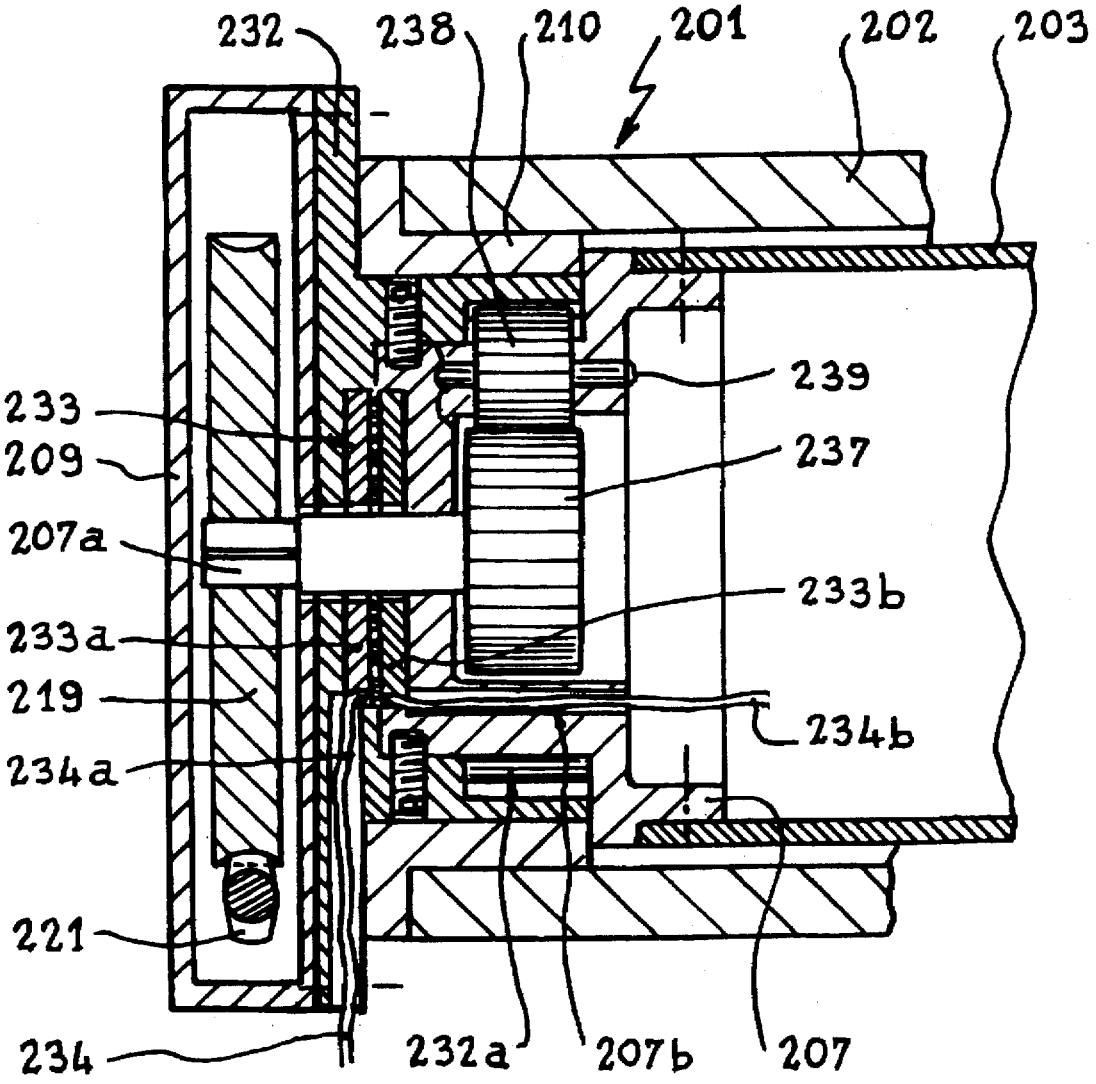
FIG. 8 is a view similar to that of FIG. 7 showing a fourth embodiment of an operating device for rolling shutters.

FIG. 8 shows a fourth embodiment of the present invention in which the reference numbers of the parts similar to those of FIG. 7 are increased by 100. This device differs from the previous one essentially in that a differential connection is provided between the shaft **207*a* and the flange 207**, and because the limit switch is replaced with detectors that, by way of example, are positioned along the path of the rolling shutter.

The differential connection between the shaft **207*a* and the flange 207 is established by means of a toothed wheel 237 mounted at the opposite extremity of the shaft 207*a* that is provided with the toothed wheel 219. The toothed wheel 232*a* engages with a pinion 238 that meshes with inside teeth 232*a* of the stationary part 232. The axis of rotation 239 of the pinion 238 rests upon the flange 207 in such a manner that the toothed wheel 237 may cause the flange 207 to rotate by using the pinion 238 as a planet gear. It is understood that several pinions 238, may be distributed along the periphery of the toothed wheel 237**.

The mechanism operates as follows. While the toothed wheel 219 is immobilized by the endless screw 221, the toothed wheel 237 blocks the rotation of the flange 207. Should the connection between the endless screw 221 and the toothed wheel 219 be disengaged, the toothed wheel 237 may be turned by the pinion 238 and it no longer prevents the movement of the flange 207.

The differential connection established between the toothed wheel 219 and the flange 207 allows the use of the ratio of the number of teeth of the elements 237, 238 and **232*a* in order to constitute a speed reducer. Moreover, this construction is particularly advantageous for heavy rolling shutters, such as the protective iron bars of stores. In fact, in such a case, the motor is subjected to a considerable torque and the differential connection allows a reduction of the stress at the contact point between the endless screw 221 and the toothed wheel 219**, which leads to a reduction of the disengaging stress of their respective teeth and facilitates the release.

It is understood that the differential connection is also applicable to a mechanism that incorporates a limit switch. This modification is within the understanding of those skilled in the art.

This invention was explained with rolling shutters driven by electric motors but it is applicable to whatsoever type of driving device is used for rolling shutters. In particular, it is applicable to a rolling shutter operated by means of a mechanical winch.

What is claimed is:

1. An operating device for rolling shutter assemblies comprising, a reeling shaft having an elongated axis and first and second ends, a shutter mounted to said shaft, said shaft being caused to rotate by a motor connected to a flange, a wheel having a plurality of spaced teeth connected to said flange adjacent said first end of said shaft, a screw means mounted adjacent said wheel and having thread portions for selectively meshing between said teeth of said wheel so that a mechanical connection is selectively established between said screw means and said wheel, said thread portions of said screw means having at least one flat portion whereby said screw can be disengaged from said wheel upon rotation of said screw means to align one of said at least one flat portions adjacent said teeth of said wheel.

2. The operating device of claim 1, wherein said screw means includes flat portions symmetrically arranged on opposite sides of an elongated axis of said screw means.

3. The operating device of claim 1, including spring means for elastically resisting the rotational adjustment of said screw means.

4. The operating device of claim 1, including an equalizer spring connected to rotate said shaft in such a manner as to roll-up said shutter around said shaft when the mechanical connection between said wheel and said screw means is disengaged.

5. The operating device of claim 1, including a speed reducer for controlling the unwinding of said shutter when the mechanical connection between said wheel and said screw means is disengaged.

6. The operating device of claim 1, in which said at least one flat portion of said screw means is obtained by machining a screw of a type utilized in a device for rolling shutters operated by a mechanical winch.

7. The operating device of claim 1, wherein the mechanical connection between said screw means and said wheel is re-established after having been disengaged by rotation of said screw means.

8. The operating device of claim 1, wherein said motor is selected from the group of motors consisting of an electric motor and a mechanical winch.

9. The operating device of claim 1, including an electric rotating connector arranged between said flange and a stationary part of the device.

10. The operating device of claim 1, including a differential connection between said wheel and said flange.

11. The operating device of claim 9, including a limit switch that rests on said stationary part opposite to said flange.

* * * * *